US007316504B1

(12) United States Patent
Mock et al.

(10) Patent No.: US 7,316,504 B1
(45) Date of Patent: Jan. 8, 2008

(54) MECHANICALLY REGULATED TIMEPIECE

(75) Inventors: Elmar Mock, Biel (CH); Begona Guerry, Pully (CH); Elio Mariotto, Solothum (CH)

(73) Assignee: Watch-U-License AG, Bundesplatz, Zug (CH)

( * ) Notice: Subject to any disclaimer, the term of this patent is extended or adjusted under 35 U.S.C. 154(b) by 579 days.

(21) Appl. No.: 10/070,137

(22) PCT Filed: Aug. 31, 2000

(86) PCT No.: PCT/CH00/00464

§ 371 (c)(1),
(2), (4) Date: May 21, 2002

(87) PCT Pub. No.: WO01/18611

PCT Pub. Date: Mar. 15, 2001

(30) Foreign Application Priority Data

Sep. 2, 1999 (EP) ..... 99117231

(51) Int. Cl.
*G04B 15/00* (2006.01)
*G04B 19/20* (2006.01)

(52) U.S. Cl. ..... 368/127; 368/140; 368/163

(58) Field of Classification Search ..... 368/124, 368/125, 127, 168, 169, 177
See application file for complete search history.

(56) References Cited

U.S. PATENT DOCUMENTS

| | | | | |
|---|---|---|---|---|
| 871,387 | A | 11/1907 | Burtin | |
| 4,215,532 | A * | 8/1980 | Perrot | 368/168 |
| 5,608,694 | A * | 3/1997 | Grimm et al. | 368/127 |
| 5,838,641 | A * | 11/1998 | Tohkoku et al. | 368/127 |
| 6,367,965 | B1 | 4/2002 | Kiu | |
| 6,402,368 | B1 * | 6/2002 | Grimm et al. | 368/127 |
| 6,749,333 | B2 * | 6/2004 | Scheufele | 368/127 |
| 2003/0112709 | A1 * | 6/2003 | Mojon | 368/127 |

FOREIGN PATENT DOCUMENTS

| | | |
|---|---|---|
| CH | 33368 | 8/1905 |
| CH | 34394 A | 4/2006 |
| CH | 118261 A | 8/2006 |
| CH | 37771 A | 7/2007 |
| EP | 0 681 227 A | 11/1995 |

(Continued)

OTHER PUBLICATIONS

Curtis D. Thomson: "Prescher's Torkel: A Brief Introduction", Feb. 2, 1003.*

(Continued)

*Primary Examiner*—P. Austin Bradley
*Assistant Examiner*—Jeanne-Marguerite Goodwin
(74) *Attorney, Agent, or Firm*—Robert E. Bushnell, Esq.

(57) ABSTRACT

The invention concerns a timepiece with mainspring of the so-called fly tourbillon type, the tourbillon having a balance bridge (2) forming a cage with a collet (1) and a single protruding ball bearing (5) supporting said so-called fly tourbillon assembly. Said so-called fly tourbillon assembly is visible on the dial side (15) and is designed as an independent tourbillon module. Said tourbillon module is separable from the clockwork (13) by being detached on the rear side of the clockwork (13) and by being removed on that same side.

31 Claims, 5 Drawing Sheets

FOREIGN PATENT DOCUMENTS

GB 2027232 A * 2/1980

OTHER PUBLICATIONS

Reinhard Meis: "Das Tourbillon", 1993, Callwey Verlag, München xp002152260, pp. 69-70, XP002152260.
Fritz Hönig: "Das Tourbillon: Faszination der Drehung—1aut Bewunderung und viele leise Fragen"; Uhren Juwelen Schmuck, vol. 12, Dec. 1992, pp. 31-34, XP000335870.
Reinard Meis: "Das Tourbillon", 1993, Callway Verlag, München XP002124090, pp. 277.
Richard Good: "The first triple tourbillon", Horological Journal, vol. 125, Apr. 1983, pp. 15-17, XP002124087; Kent Ashford, p. 15.
Journal Suisse D'Horlogerie Et De Bijouterie, vol. 1, 1982, pp. 40-47, XP002124088.
Société Suisse de Chronométrie/Ass. Suisse de Microtechnique, 59e Congrès, Oct. 4-5, 1985, Neuchâtel, Suisse. XP002124089.
A Web page "Tourbillon-Compensating for gravity" retrieved from <http://www.blancpain.com/e/complications/tourbillon/> on Apr. 5, 2006.
A Web page "Tourbillon" retrieved from <http://www.en.wikipedia.org/wiki/Tourbillon> on Apr. 5, 2006.
A Web page "The Tourbillon: The Heart of Precision" written by Patrizzi, retrieved from <http://www.antiquorum.com/html/vox/vox2004/tourbillon.htm> pp. 1-4 on Apr. 5, 2006.
A Web page "Detailed Descriptions of the Added Complication" retriev ed from <http://www.tp178.com/jd/uber-comp/artikel_4_4.html> on Apr. 6, 2006.
A Web page "Movement TT791 ' Tourbillon'" retrieved from <http://www.technotime.com/mouv/mecanique/tt791_e.html> on Apr. 6, 2006.
A pdf format "TT791.54" retrieved through a Web page <http://www.technotime.com/mouv/mecanique/tt791_e.html> on Apr. 6. 2006.
A Web page "The Enigma" written by Perez, retrieved from <http://www.timezone.com/library/cjrml/cjrml0008> on Apr. 6, 2006.
A Web page "Biver and Piguet: The Lost Works" retrieved from <http://www.timezone.com/library/cjrml/cjrml0029> on Apr. 6, 2006.
A Web page "Omega Center Tourbillon ref. 5910.30.01, cal. 1170" retriev ed from <http://www.thepurists.com/jpg/tourbillon/omegacentertourbillon.html> on Apr. 6, 2006.

* cited by examiner

MECHANICALLY REGULATED TIMEPIECE

BACKGROUND OF THE INVENTION

1. Technical Field

The present invention relates to a mechanically regulated time indicator particularly suited for use in wrist-watches.

2. Related Art

The present invention falls into the family of so-called tourbillon time indicators. The conventional type of such a time indicator is represented by the Bréguet Tourbillon from 1795. In this device, a balance, its spiral spring and its escapement are assembled in the interior of a turning cage, the rotational speed of which is one revolution per 60 seconds. The cage turns about a double bearing gear.

In the development of wristwatches, a reduction in the number of bearings is observed. The patent GB-21421 from 1892 describes a tourbillon cantilevered in a single large bearing. Patent CH-353679 from 1961 describes a cantilevered bearing construction of the ball bearing type wherein the ball bearing replaces the thick smooth bearing used up to that time. Nowadays, cantilevered bearings of the ball bearing type are widely used, exemplified by the constructions in accordance with U.S. Pat. No. 4,132,061 from 1977.

The speed of rotation can be less than 60 sec. per revolution as is shown by the tourbillon of Albert H. Potter published in the work "Horlogerie Ancienne" no. 22, 2nd semester 1987, pages 64-71.

Since then, numerous variations in construction have been reported. The work "Das Tourbillon" by Reinhard Meis, Callway Verlag Münich, $2^{nd}$ Ed., 1993, provides a very good overview of the subject. Thus, one can differentiate tourbillons mounted in a non-visible or a visible fashion, as seen from the side of the dial. To be non-visible, a tourbillon is mounted with its base on the dial side. To be visible, a tourbillon is mounted with a bridge on the dial side.

Often, the tourbillons are arranged in the six o'clock, twelve o'clock positions on the dial or in the middle of the dial. Such creations of tourbillons arranged in the six o'clock or twelve o'clock positions are shown in the work "Das Tourbillon" by Reinhard Meis, Callway Verlag Munich, $2^{nd}$ Ed., 1993. The creation in the middle of the dial implies that the tourbillon is mounted on the central staff of the time indicator, resulting in a relatively thick construction.

A particularly aesthetic tourbillon is known by the name flying tourbillon. Such a flying tourbillon is described, for example, in the work "Drehganguhren" by Alfred Helwig, Verlag der Deutschen Uhrmacher-Zeitung, Berlin, 1927. This flying tourbillon has no component that covers the cage. Another flying tourbillon, visible from the dial side and projecting beyond the movement is reported in the work "Faszination der Uhrentechnik" by Reinhard Meis, page 276, Laterna magica.

All these tourbillon constructions are known to present the disadvantage of being understood as components, which are indissociable from the watch movement. This makes their final adjustment tricky and their customisation (decoration, design, frequency) if not impossible, then certainly difficult.

An object of the present invention is to provide an astute construction of a time indicator of the balance spring flying tourbillon type visible from the dial side. A further object of the invention is to provide a solution to the above-mentioned disadvantage and to describe an economical and flexible process for the assembly and/or adjustment of watches. A final object of the invention is to provide a particularly aesthetic and slim time indicator for wristwatches.

The object is provided by the invention as defined by the Claims.

The present invention relates to a time indicator of the balance spring flying tourbillon type. This flying tourbillon is visible from the dial side and comprises a balance bridge forming a cage with a collet. Its cantilevered single bearing supports the said flying tourbillon assembly. The cantilevered single bearing is of the ball bearing type. The flying tourbillon assembly is designed as an independent tourbillon module, visible from the dial side of the movement and separable from the other side of the movement. All the components can be assembled together and adjusted independently from the movement.

SUMMARY OF THE INVENTION

Compared with a conventional mechanically regulated time indicator of the balance spring tourbillon type, the invention presents the following advantages:

- The time indicator is provided with a cantilevered bearing of the ball bearing type thus permitting a particularly simple and robust construction that requires fewer components.
- The time indicator is mounted in such a way that it is visible from the dial side and has no part overlapping the cage. This enables a particularly aesthetic, easily obtainable and slim construction. This construction is adapted for large and small calibres.
- The time indicator includes an assembly of a tourbillon collet, a balance bridge, cannon, ball bearing and a tourbillon bridge forming a tourbillon module supporting the regulatory organs, that is the oscillating balance and balance spring with pallet, pallet wheel and pinion and interior-toothed crown. The whole is fully separable from the movement, has the advantage that it can be assembled by itself and be adjusted outside the movement. This tourbillon module is independent from the movement in so far as the frequency, the finish or the adjustment are concerned.
- In a preferred embodiment the balance bridge itself serves as an indicator by its shape and/or decoration. Such a balance bridge can be created in a material so as to permit maximum visibility of the moving parts. Such a bridge is, for example, of a transparent or semi transparent nature, disposed with precious stones and/or precious metals and/or ornaments as indicator.

BRIEF DESCRIPTION OF THE DRAWINGS

The invention will be described in more detail with the help of the following figures in which:

DETAILED DESCRIPTION OF THE PREFERRED EMBODIMENT

Figure 1:
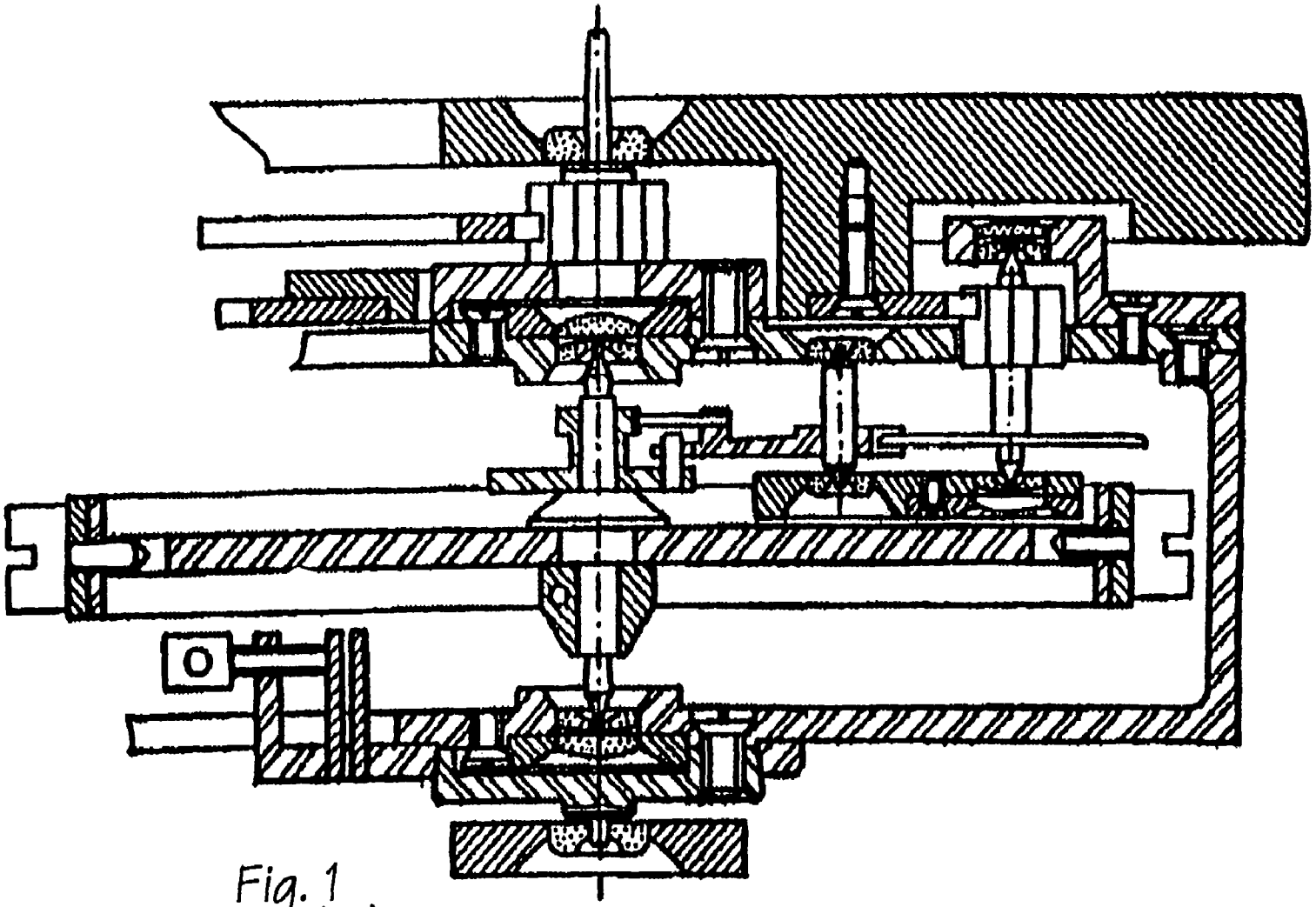
Fig. 1 (Prior Art)
Figure 2:
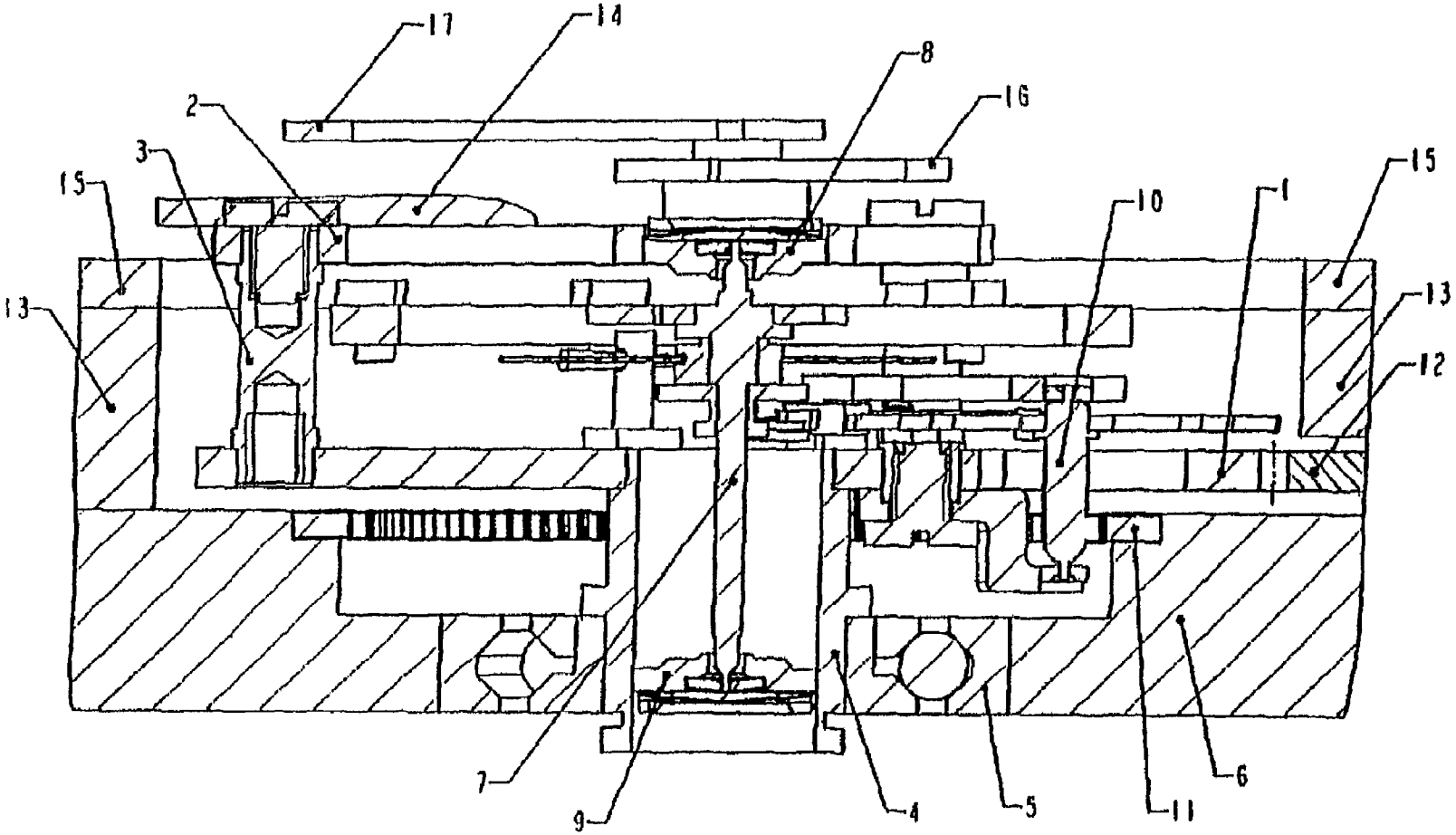
Figure 3:
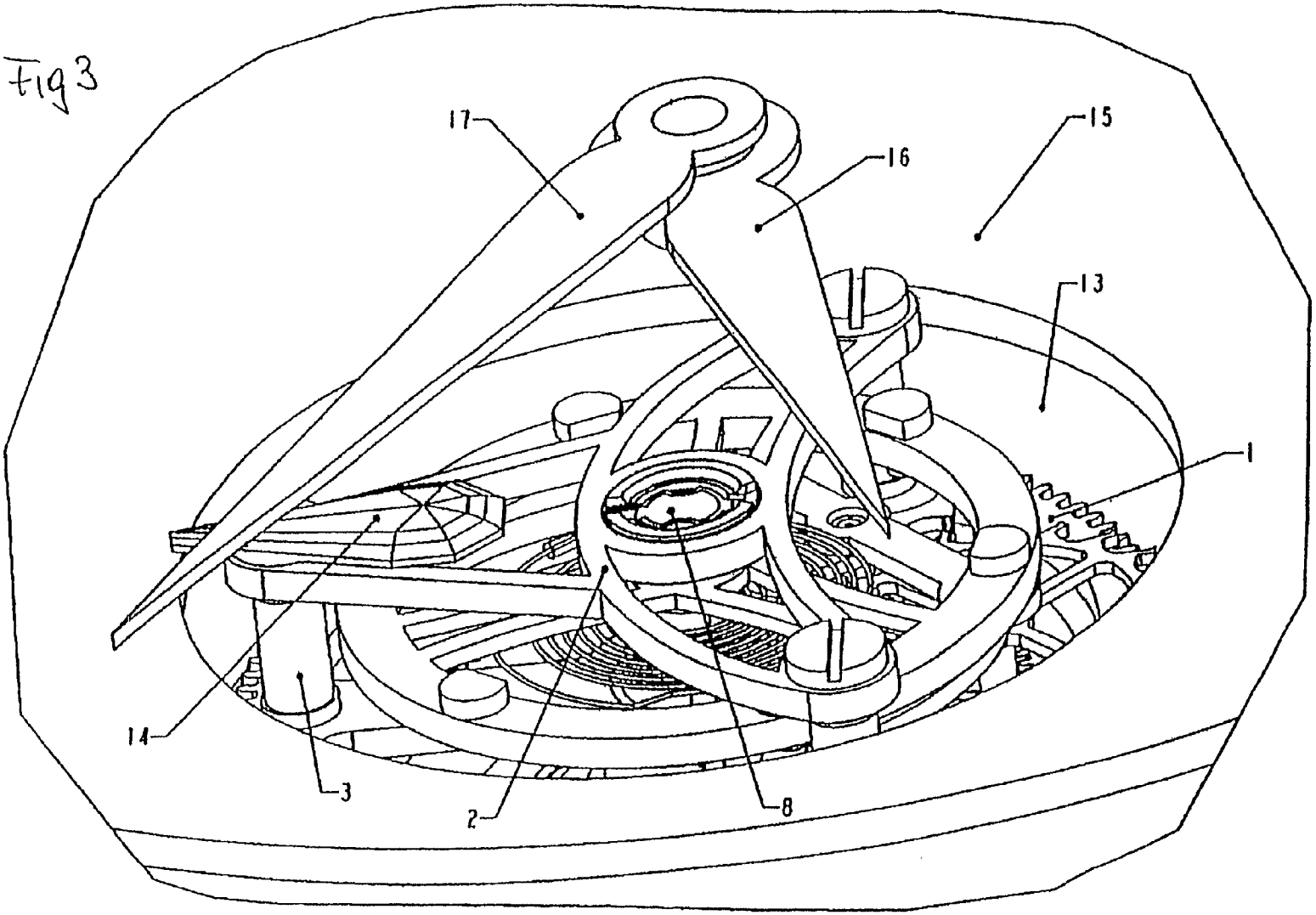

FIG. 1 is a cross-sectional view of a tourbillon regulated time indicator,

FIG. 2 is a cross-sectional side view of the detail of an exemplary embodiment of a regulated time indicator according to the invention, FIG. 3 is a top view of the detail of an exemplary embodiment of a regulated time indicator according to FIG. 2.

Figure 4:
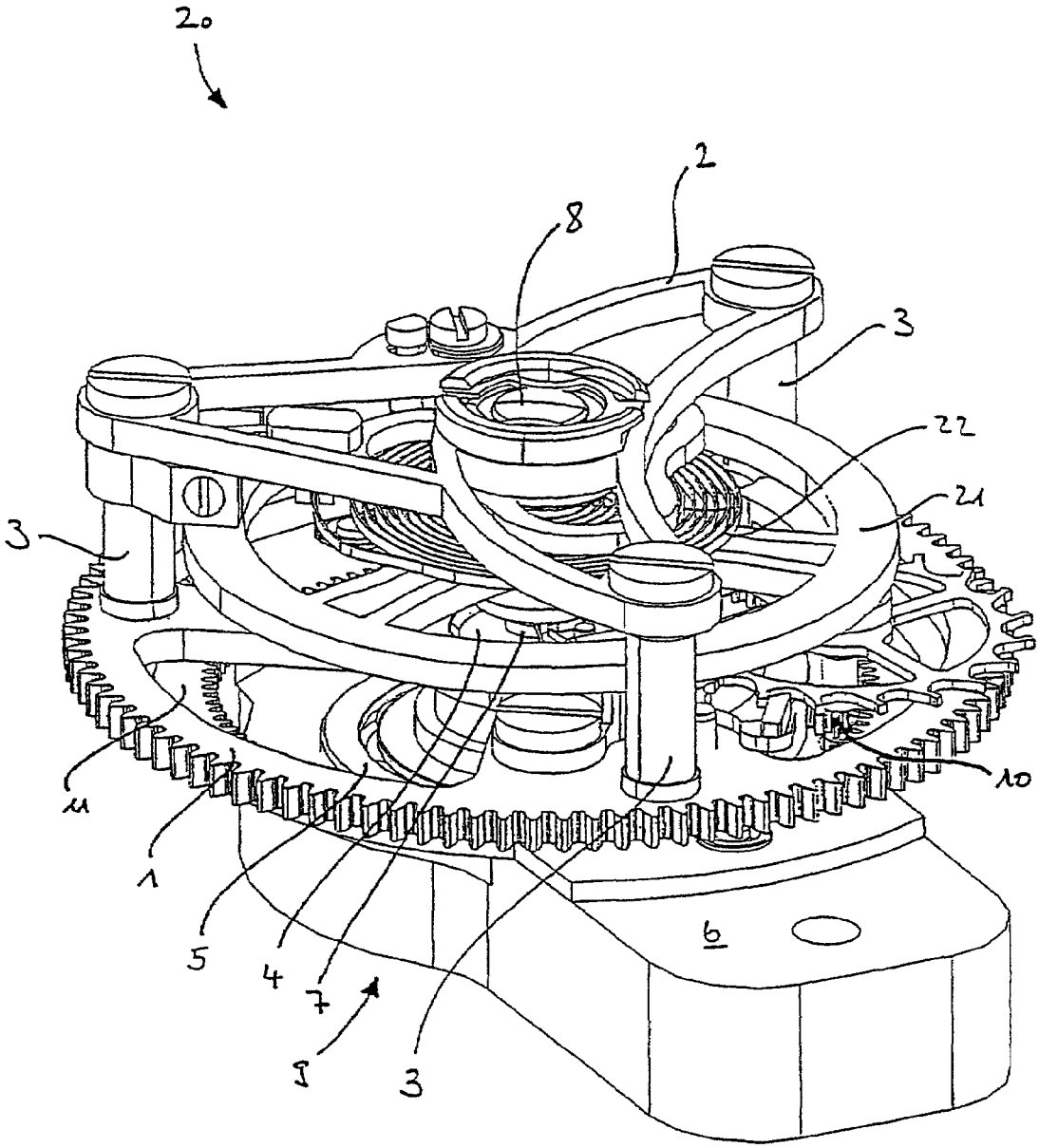

FIG. 4 is a perspective view of a tourbillon module for a time indicator according to the invention.

Figure 5:
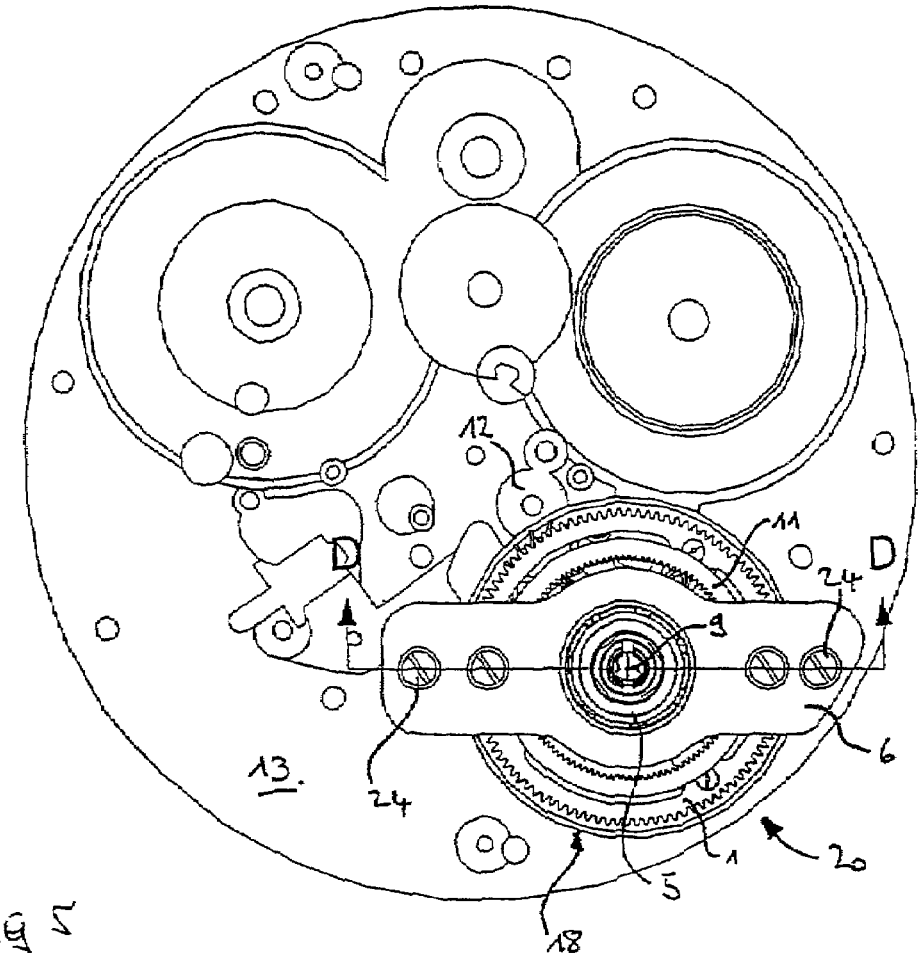

FIG. 5 is a view of the rear side of a movement carrying the tourbillon module according to FIG. 4.

Figure 6:
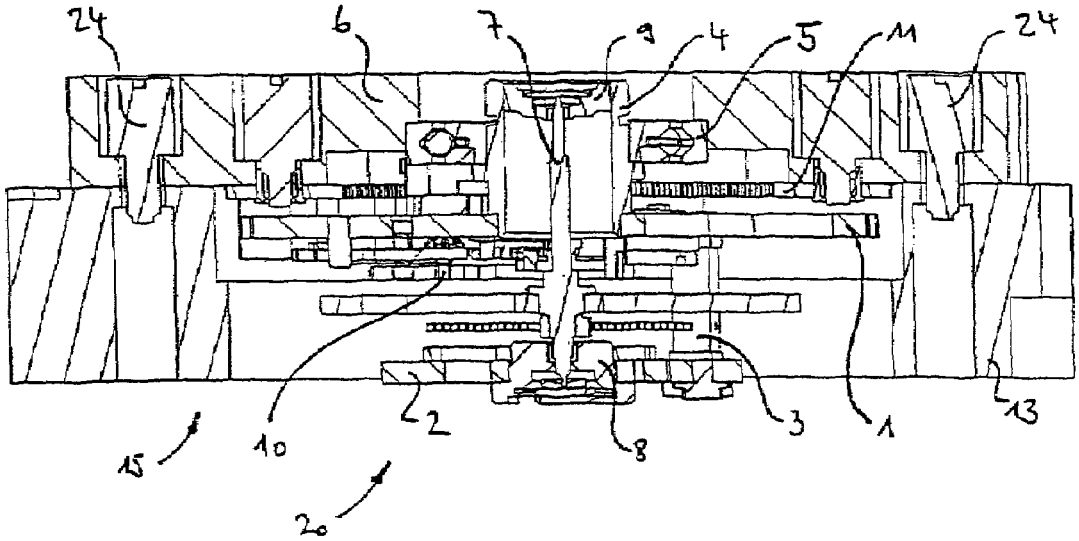

FIG. 6 is a cross-sectional view of the detail along the line D-D of FIG. 5.

FIG. 1 is a cross-sectional view of a balance spring tourbillon regulated time indicator. In this device, a balance, its spiral spring and the tourbillon collet are assembled inside a turning cage that rotates at a speed of 60 sec. per revolution. The whole cage turns around a double bearing gear.

FIGS. 2 and 3 are different views of detail of the exemplary embodiments of a regulated time indicator according to the invention. FIG. 2 is a cross-sectional view from the side and FIG. 3 is a view from above.

This exemplary embodiment of a balance spring type time indicator refers to a flying tourbillon. It comprises a conventional oscillator with balance, balance-spring and escapement. It functions, for illustrative purposes, with a Swiss pallet escapement. This exemplary embodiment is by no means limiting. A person having ordinary skill in the art, on learning the present invention, can create a flying tourbillon with another escapement system (for example, a check or detent escapement system) or with another known regulating system.

This oscillator is mounted in the interior of a tourbillon cage. The tourbillon cage turns about a bearing. The tourbillon is visible from the side of dial 15. In particular, on the side of dial 15, the tourbillon cage is formed by a balance bridge 2 attached to a tourbillon collet 1 by the pillars 3. Thus, the flying tourbillon is entirely visible and has no parts that overlap the cage.

The single bearing is a cantilever ball bearing construction. On the bottom side, the cannon 4 is held axially in the ball bearing 5 that enables it to turn freely. This ball bearing 5 is attached by an external ring to a tourbillon bridge 6.

The tourbillon collet 1 is the part with the greatest diameter and thus defines the space required in the plane of the watch. This tourbillon collet 1 accepts the toothing that engages with a last wheel 12 of a movement 13. The oscillator is maintained by a shaft 7 having a first extremity 9 driven into cannon 4 attached to the collet 1 and a second extremity 8 driven into the balance bridge 2. These extremities 8 and 9 can include anti-shock units. The movement of the Swiss pallet type oscillator is maintained by a pallet and a pallet wheel borne by the tourbillon collet 1. The pallet and pallet wheel, borne by the tourbillon collet 1, turn with the tourbillon collet 1 about the axis of the latter. The pallet wheel is disposed with a pinion 10, which engages with an internal toothed crown 11 attached to the tourbillon bridge 6, thereby creating the rotation of the pallet wheel 10 about its own axis by the motion of the tourbillon collet 1.

According to the exemplary embodiment, the balance is centered with respect to the single bearing. This exemplary embodiment is by no means limiting. A person skilled in the art and knowing the present invention can create a flying tourbillon with a balance eccentrically arranged inside the tourbillon cage.

The assembled tourbillon collet 1, balance bridge 2, cannon 4, ball bearing type bearing 5 and tourbillon bridge 6 form an integral module that supports the regulatory organs, that is, the balance spring oscillator with pallets, pallet wheel, pinion 10 and internal toothed crown 11. The entire arrangement is a tourbillon module that is completely detachable from the movement 13.

The tourbillon module has the advantage that it can be assembled by itself and adjusted outside the movement. This tourbillon module is independent of the movement 13 insofar as the frequency, decoration or adjustment are concerned. A movement 13 can be fitted with tourbillon modules of different frequencies and/or different aesthetic creation. This results in the assembly and maintenance of such a tourbillon module being particularly easy, fast, economical and flexible. In particular, this tourbillon module can be mounted into the watch at the last moment. Thus, it is possible to have a relatively small stock of tourbillon modules and be able to satisfy customers' wishes in a flexible manner, enabling customization of the watch.

Advantageously, the flying tourbillon according to the invention is arranged in the plane of the dial 15 of a watch or wristwatch in such a way that it is visible from the dial side in the six o'clock or twelve o'clock position. Due to its small thickness, this flying tourbillon can be arranged in the movement 13 in a raised manner with respect to the dial, making the tourbillon and its parts particularly well visible. An indicator hand (for example, an indicator 14 for a small second hand) can be fixed to the balance bridge 2.

In addition and in place and instead of a second hand, the balance bridge 2 can itself serve as an indicator by means of its shape and/or by an associated decoration. For this purpose, the balance bridge is, for example, created transparent or semi transparent. It can be disposed with precious stones and/or precious metals and/or ornamentations as indicators. A person skilled in the art and knowing the present invention can create other examples of such indicators.

This tourbillon is visible from the side of dial 15. The total height of the tourbillon module can vary so as to bring the surface of the tourbillon higher than that of the dial 15 but still below the sweep of the hour hand 16 and minute hand 17.

The compatibility between a family of movements and a family of tourbillon modules is assured by means of an interface, thereby ensuring an interchangeability of the tourbillon modules. The interfacial element ensures that the tourbillon collet 1 maintains a characteristic speed of rotation, for example, 60 sec. per revolution. This is provided by an interfacial element, for example, by the geometry of its toothing, by the number of teeth, and/or by the shape and positions of the teeth in the movement 13, so as to interlock perfectly with the last wheel 12 of the movement 13. The demultiplication ratio can be adjusted such that interchangeability can be ensured. If, for example, the oscillator frequency is reduced by a factor, then the original ratio of the diameter of the pinion 10 to that of the internal toothed crown 11 must increase by the same factor.

FIGS. 4, 5 and 6 illustrate in more detail the modularity of the tourbillon of the time indicator according to the invention.

FIG. 4 is a schematic perspective view of an exemplary embodiment of a flying tourbillon module 20 for a time indicator according to the invention. The tourbillon is, in principle, the same as that already shown in FIGS. 2 and 3. It comprises a balance 21 mounted on a shaft 7 with a first extremity 9 and a second extremity 8, a spring 22, a tourbillon collet 1, pillars 3, a balance bridge 2, a cannon 4, an internal toothed crown 11, a ball bearing type bearing 5 and a pinion 10. The tourbillon is mounted on a tourbillon bridge 6. In this device the balance wheel 21, its balance spring 22 and the tourbillon collet 1 are assembled in the interior of a turning cage formed by the pillars 3, the balance bridge 2 and the tourbillon collet 1.

FIG. 5 is a view from the bottom or back (side opposite to the dial side) of a movement 13 with a tourbillon module 20 as illustrated in FIG. 4 and which is mounted on the movement 13. The tourbillon bridge 6 is fixed onto the bottom side of movement 13 by screws 24. Thus, to separate the tourbillon module 20 from the movement 13, one only needs to unscrew the screws 24 and remove the module 20 from the movement 13.

The tourbillon collet 1 receives the toothing engaging with a last wheel 12 arranged in a recess of the movement 13.

FIG. 6 is a cross-sectional view of the detail along the fine D-D of FIG. 5 and resembles FIG. 2 but shows more clearly the modularity of the tourbillon and its extension into the movement 13. The tourbillon bridge 6 is fixed on the bottom side or back of the movement 13 and the tourbillon module 20 extends into an opening 18 of the movement 13 up to the side of dial 15 of the latter.

The ball bearing type bearing 5 is not arranged on the same level as the first extremity 9 of the shaft 7 (as illustrated in FIG. 2) but is distanced from this first extremity 9 of shaft 7 toward the level of the center of gravity of the rotating module 20. This position of the bearing 5, as close as possible to the center of gravity, renders the arrangement more resistant to shocks.

FIG. 6 clearly shows that, in order to detach the tourbillon module 20 from the movement 13, no other component need be removed. Thus, the assembly and maintenance of such a tourbillon module 20 is particularly easy, rapid, economical and flexible. In particular, the tourbillon module 20 can be mounted in the watch at the last minute. That means that the movement 13 and the tourbillon module 20 can be manufactured and assembled completely independently. Thus, it is possible to have a relatively small stock of tourbillon modules and to be able to satisfy the customers' wishes in a flexible manner, enabling customization of the watch. If servicing work is required, the whole movement does not need to be disassembled to gain access to the tourbillon, nor does the case need to be separated from the movement. Although the tourbillon is visible from the side of dial 15, to remove it one only needs to open the watch from the back, unscrew the module, and withdraw the module from the movement.

Although the preferred embodiments of the present invention have been described, it will be understood by those skilled in the art that the present invention should not be limited to the described preferred embodiment. Rather, various changes and modifications can be made within the spirit and scope of the present invention, as defined by the following claims.

The invention claimed is:

1. A time indicator, comprising:

a movement element encased between a dial side driven by said movement element to provide a representation of time, and a reverse side, said movement element containing an opening extending through said reverse side to said dial side; and a flying tourbillon module that is an independent element relative to said movement element being removably insertable into said opening via said reverse side, said flying tourbillon being visible from said dial side of said movement element while said flying tourbillon resides within said opening, and being removably separable from said movement element while operationally assembled as said flying tourbillon module via said reverse side of said movement element, said flying tourbillon module comprising a cantilevered bearing that supports said flying tourbillon module.

2. The time indicator of claim 1, said flying tourbillon module comprising:

a balance bridge;

a collet forming a cage with said balance bridge; and a balance wheel disposed in said cage between said collet and said balance bridge.

3. The time indicator of claim 2, with said flying tourbillon module comprised of a single bail bearing.

4. The time indicator of claim 2, said flying tourbillon module further comprising a shaft on which said balance wheel is mounted, said shaft having an end, and a bearing positioned a distance from said end of said shaft at a level of a center of gravity of said flying tourbillon module.

5. The time indicator of claim 2, wherein said collet has a diameter greater than a diameter of any other element so as to define a space requirement in a plane of the time indicator.

6. The time indicator of claim 2, wherein said balance wheel is arranged eccentrically within the cage.

7. The time indicator of claim 6, wherein said regulatory elements include an oscillator shaft having an end, a bearing positioned between a plane of said end of said oscillator shaft and a plane of a center of gravity of said flying tourbillon module.

8. The time indicator of claim 7, comprising a shaft supporting said oscillator, said shaft having a first extremity driving into a cannon fixed to the collet and a second extremity driven into the balance bridge.

9. The time indicator of claim 2, wherein said flying tourbillon module further comprises a shaft on which said balance wheel is mounted, a cannon surrounding said shaft, and a tourbillon bridge, and wherein said balance bridge, said collet, said balance wheel, a bearing and said tourbillon bridge forming an integral unit supporting regulatory elements of said time indicator.

10. The time indicator of claim 2, wherein said balance bridge is formed of one of a transparent material and a semi-transparent material so as to serve as a second hand of said time indicator.

11. The time indicator of claim 2, wherein said balance bridge carries at least one of precious stones, precious metals and ornaments so as to serve as a second hand of said time indicator.

12. The time indicator of claim 2, with said movement comprising an opening extending from the front to the back of the movement, where by said opening has a diameter which is larger than the diameter of said collect.

13. The time indicator of claim 1, wherein said flying tourbillon module is positioned in a plane of a dial of the time indicator and is visible from the dial side of the time indicator in one of a six o'clock position and a twelve o'clock position.

14. The time indicator of claim 1, said time indicator including a dial, said flying tourbillon module being positioned in said movement element in a raised manner relative to said dial.

15. A method of installing a balance spring flying tourbillon in a time indicator, comprising the steps of:

(a) providing the time indicator comprised of a movement element and regulatory elements disposed between a dial side and a reverse side of said time indicator, said movement element containing an opening extending through said reverse side to said dial side;

(b) providing a flying tourbillon module comprised of a plurality of elements forming an integral module supporting the regulatory elements; and (c) mounting the flying tourbillon module within said opening as said integral module operationally engaging the time indicator with operational movements of said flying tourbillon module being visible from said dial side and said flying tourbillon module being removably separable as said integral module from the movement element via said reverse side.

16. The method of claim 15, wherein the plurality of elements of said flying tourbillon module comprises at least one of a balance bridge, a collet, a balance wheel, a cannon, a bearing, and a tourbillon bridge.

17. The method of claim 16, wherein the collet is arranged within the opening of the movement element which extends from the front side to the back side of the movement element.

18. The method of claim 15, wherein step (b) comprises assembling said flying tourbillon module as a separate component relative to said movement element and said regulatory elements of said time indicator.

19. The method of claim 15, wherein said flying tourbillon module is separable from said time indicator and is thereby adjustable outside the movement element of said time indicator.

20. The method of claim 15, wherein step (c) comprises inserting the flying tourbillon module from a side of the movement element opposite to the dial side of the time indicator.

21. The method of claim 20, wherein step (c) further comprises inserting the flying tourbillon module into the opening in the movement element.

22. The method of claim 21, wherein step (c) further comprises fixing the flying tourbillon module to the movement element on the side of the movement element opposite to the dial side of the time indicator.

23. The method of claim 22, wherein the plurality of elements of said flying tourbillon module includes a tourbillon bridge, and step (c) comprises fixing the tourbillon bridge of said flying tourbillon module to the movement element on the side of the movement element opposite to the dial side of the time indicator.

24. The method of claim 15, wherein step (c) comprises inserting the flying tourbillon module into the opening in the movement element.

25. The method of claim 15, wherein step (c) comprises fixing the flying tourbillon module to the movement element on a side of the movement element opposite to a dial side of the time indicator.

26. The method of claim 15, wherein the plurality of elements of said flying tourbillon module includes a tourbillon bridge, and step (c) comprises fixing the tourbillon bridge of said flying tourbillon module to the movement element on the reverse side of the movement element opposite to the dial side of the time indicator.

27. A time indicator, comprising:

a flying tourbillon module assembled independently from a movement element that is encased between a dial side of the movement element driven by the movement element to provide a representation of time, and a reverse side of the movement element, said flying tourbillon module operationally engaging a constituent element of the movement element when said flying tourbillon module is removably inserted via the reverse side into an opening in the movement element that extends between the dial side and the reverse side, said flying tourbillon being visible from said dial side of said movement element while said flying tourbillon resides within said opening, and being removably separable from said movement element while operationally assembled as said flying tourbillon module via said reverse side of said movement element, and said flying tourbillon module comprising a cantilevered bearing that supports said flying tourbillon module.

28. The time indicator of claim 27, wherein extremities of said shaft comprise anti-shock units.

29. The time indicator of claim 28, comprising a pallet oscillator with a pallet wheel.

30. The time indicator of claim 29, comprising an internal toothed crown attached to the balance bridge, whereby said pallet wheel is engaged with said internal toothed crown creating the rotation of the pallet wheel about an axis of said pallet wheel by the motion of the collet.

31. The time indicator of claim 27, with said flying tourbillon comprising a ball bearing.

* * * * *